United States Patent [19]

Famularo

[11] 4,283,985

[45] Aug. 18, 1981

[54] DRUMS

[76] Inventor: Dominick S. Famularo, 1897 Voshage St., Baldwin, N.Y. 11510

[21] Appl. No.: 24,418

[22] Filed: Mar. 27, 1979

[51] Int. Cl.[3] ..... G10D 13/02

[52] U.S. Cl. ..... 84/411 R; 84/413; 84/414

[58] Field of Search ..... 84/411–417, 84/419–420

[56] References Cited

U.S. PATENT DOCUMENTS

| | | | |
|---|---|---|---|
| 794,658 | 7/1905 | Boulanger | 84/411 R |
| 1,144,452 | 6/1915 | Wanamaker | 84/411 R |
| 1,597,026 | 8/1926 | Egermayer | 84/411 R |
| 3,136,201 | 6/1964 | Lang et al. | 84/411 R |
| 3,533,324 | 10/1970 | Price | 84/411 R |

*Primary Examiner*—Lawrence R. Franklin

*Attorney, Agent, or Firm*—Stanley Ira Laughlin

[57] ABSTRACT

An improved drum rim for a drum in which a portion of the periphery of the upright section of the rim is either omitted or substantially reduced.

5 Claims, 6 Drawing Figures

DRUMS

BACKGROUND OF THE INVENTION

In addition to accentuating the beat, drummers are called upon to produce a variety of sound effects by the use of their drumsticks. One way this is done is by beating Tom Toms or Cymbols with the drumsticks. However, sometimes the rim is accidentally struck by the drumsticks, resulting in unwanted clicking sounds that can't be tolerated.

Drum rims of the type upon which applicant's improvement may be practiced are described in U.S. Pat. No. 3,647,931 to Keishikawa.

SUMMARY OF THE INVENTION

It is an object of applicant's invention to provide improved drum rims that are simple and economical to make.

It is a further object of applicant's invention to provide drum rims that will not be accidentally contacted by the drummer.

Applicant's invention relates to an improved drum rim comprising vertical and horizontal edges wherein the vertical edges are either partially or totally omitted for a portion of their periphery.

DETAILED DESCRIPTION

Figure 1:
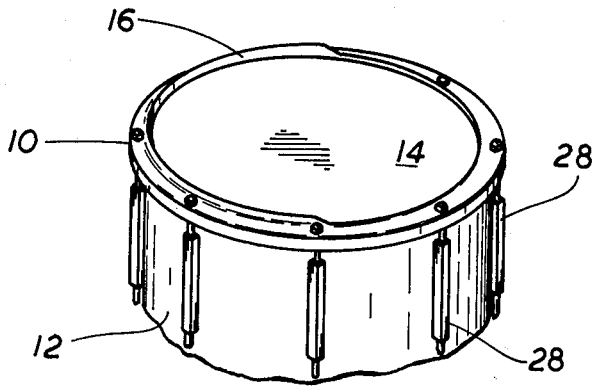
FIG. 1 is a perspective drawing of the upper part of a drum employing applicant's inventive rim.
Figure 2:
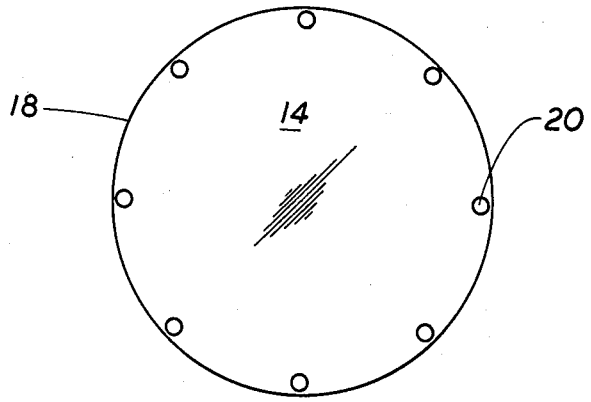
FIG. 2 is a top plan view of a drum sheet.

FIG. 1 shows one embodiment of applicant's invention. A drum 10 having a drum body 12 with a drum sheet 14 covering its open end, held in place by an improved rim 16 laying upon it, as will be more particularly described hereafter. The peripheral edge portion 18 of the drum sheet 14 has a plurality of through holes 20 formed in it at intervals, as more clearly shown in FIG. 2.

Figure 3:
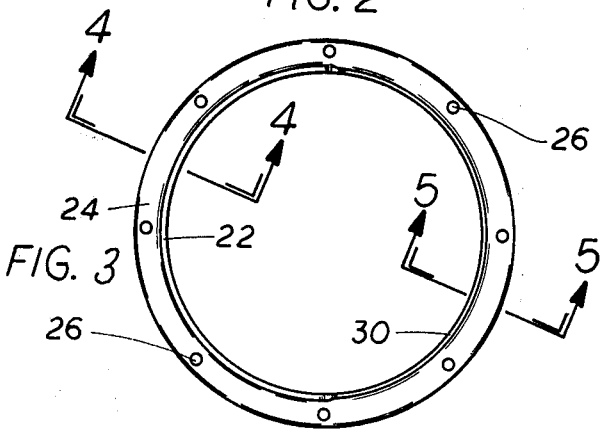
FIG. 3 is a top plan view of applicant's improved drum rim.
Figure 4:
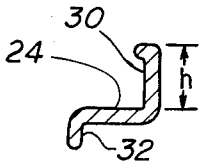
FIG. 4 is a side elevation view of the cross-section for the conventional portion of the rim as shown in FIG. 3 along the axis 4—4.
Figure 5:
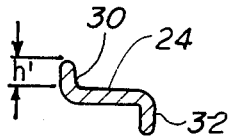
FIG. 5 is a side elevation view of the cross-section for applicant's improved reduced flange height portion of the rim shown in FIG. 3 along the axis 5—5.
Figure 6:
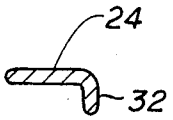
FIG. 6 is a side elevation view of the cross-section for applicant's improved omitted flange height portion of the rim which may be substituted for the reduced rim cross-sectional portions shown in FIGS. 1 and 3.

Applicant's improved drum rim 16, as more clearly shown in FIG. 3, is an annular ring having an Z shaped cross-section primarily formed by two orthogonal flanges 30 & 24 for a portion 22 of its periphery with a dimension larger than the outer circumference of drum body 12. As shown in FIG. 4, the cross-section of rim 16 is primarily formed by orthogonal flanges 30 & 24. Flange 30 extends a conventional height "h" parallel to the body of the drum. Flange 24 extends a conventional width orthogonally from the body of the drum. A third flange 32, which is optional, extends orthogonally from the end of flange 24 opposite the junction of flanges 30 & 24 and may additionally serve to clamp drum sheet 14. Flange 32 is a matter of design and constitutes no part of Applicant's inventive rim and may be omitted in its entirety resulting in an "L" shaped cross-section in FIGS. 4 & 5 and a flat shaped cross-section in FIG. 6. It is understood that different Z flange dimensions such as shown in FIGS. 5 and 6, may also be used. The height (h') of flange 30 in FIG. 5 is less than the conventional height shown in FIG. 4 for flange 30. Applicant's embodiment, as shown in FIG. 6 shows no flange exists parallel to the body of the drum; only a flat ring for portion 30 of its outer periphery. Flange 24 of the Z shaped cross-sectional rim has a plurality of through holes 26 which align with the holes 20 in the drum sheet 14 when the rim is positioned over the drum sheet 14 and the drum body 12. The rim 16 and drum sheet 14 are clamped by a plurality of lugs 28, as shown in FIG. 1, extending orthogonally through holes 20 of the drum sheet 14 and holes 26 of the rim.

By use of applicant's improved rim, the drummer playing the drum is able to use his drumsticks to produce desired different sounds other than are produced by the drum sheet without producing unwanted clicks. He can more easily jump back and forth between the drum sheet and Tom Toms without hitting the rim with the drumsticks.

Although only embodiment of applicant's invention has been shown, applicant's invention is not to be so limited, and applicant's inventive drum improvement is to be limited in scope and breadth only by the attached claims:

I claim:

1. A drumhead comprising a drum sheet extending over the body of a drum, annular rim resting upon said drum sheet, said rim having an "Z" shaped cross-section for only a portion of its periphery formed by orthogonal flanges, one flange extending parallel to the body of the drum for a conventional height, the other flange extending orthogonal to the body of the drum for a conventional width and a cross-section for the remaining portion of its periphery formed by orthogonal flanges, one flange extending parallel to the body of the drum for a height less than said conventional height, the other flange extending orthogonal to the body of the drum for said conventional width, and lugs extending from said body of said body of said drum to clamp said drum sheet and rim.

2. A drumhead as claimed in claim 1 wherein the remaining portion of the periphery of the rim having the height of the flange extending parallel to the body of the drum that is less than said conventional height comprises half of the circumference of said rim.

3. A drumhead as claimed in claim 1 wherein the remaining portion of the periphery of the rim having the height of the flange extending parallel to the body of the drum that is less than said conventional height comprises less than half of the circumference of said rim.

4. A drumhead as claimed in claim 1 wherein the remaining portion of the periphery of the rim having the height of the flange extending parallel to the body of the drum that is less than said conventional height comprises greater than half of the circumference of said rim.

5. A drumhead comprising a drum sheet extending over the body of a drum, an annular rim resting upon said drum sheet, said rim having a first cross-section formed by orthogonal flanges for only a portion of its periphery, one flange extending a conventional height parallel to the body of the drum, the other flange extending a conventional width orthogonal to the body of the drum, and a second cross-section for the remaining portion of its periphery formed only by the flange extending a conventional width orthogonal to the body of the drum, and lugs extending from said body of said drum to clamp said drum sheet and rim.

* * * * *